US011419418B2

(12) United States Patent
Borrás Pons

(10) Patent No.: US 11,419,418 B2
(45) Date of Patent: Aug. 23, 2022

(54) REVERSIBLE CHAIR

(71) Applicant: FIGUERAS SEATING EUROPE, S.L., Lliçà d'Amunt (ES)

(72) Inventor: Pablo Borrás Pons, Barcelona (ES)

(73) Assignee: FIGUERAS SEATING EUROPE, S.L., Lliçà d'Amunt (ES)

( * ) Notice: Subject to any disclaimer, the term of this patent is extended or adjusted under 35 U.S.C. 154(b) by 0 days.

(21) Appl. No.: 17/251,701

(22) PCT Filed: Jun. 13, 2018

(86) PCT No.: PCT/ES2018/070424
§ 371 (c)(1),
(2) Date: Dec. 11, 2020

(87) PCT Pub. No.: WO2019/238983
PCT Pub. Date: Dec. 19, 2019

(65) Prior Publication Data
US 2021/0112984 A1 Apr. 22, 2021

(51) Int. Cl.
*A47C 1/121* (2006.01)
*A47C 7/56* (2006.01)

(52) U.S. Cl.
CPC ..... *A47C 1/121* (2013.01); *A47C 7/563* (2013.01)

(58) Field of Classification Search
CPC ..... B60N 2/203; A47C 1/121
USPC ..... 297/92
See application file for complete search history.

(56) References Cited

U.S. PATENT DOCUMENTS 565,375 A * 8/1896 Baier ..... B60N 2/803
3,964,785 A * 6/1976 Plume ..... A47C 17/34 5/47
4,654,902 A * 4/1987 Shrock ..... A47C 17/1756 5/37.1
4,779,917 A * 10/1988 Campbell ..... B60N 2/06 296/65.09
5,098,154 A * 3/1992 Emery ..... B60N 2/0292 297/328
6,082,805 A * 7/2000 Gray ..... B60N 2/34 296/65.09

FOREIGN PATENT DOCUMENTS

JP 7313284 U 12/1995
KR 20090005175 U 5/2009
KR 101410577 B1 6/2014

* cited by examiner

*Primary Examiner* — Sarah B McPartlin
(74) *Attorney, Agent, or Firm* — Maier & Maier, PLLC

(57) ABSTRACT

The reversible chair comprises two articulated portions (1, 2) with respect to a support (3), both articulated portions (1, 2) being able to be placed in a first position, wherein the articulated portion (1, 2) is in a substantially vertical position, and in a second position, wherein the articulated portion (1, 2) is in a substantially horizontal position, the chair further comprising two stop plates (4, 5), each of which is joined in rotation to one of the two articulated portions (1, 2), said stop plates (4, 5) being separated from each other when the two articulated portions (1, 2) are in the first position and in contact with each other when one of the articulated portions (1, 2) is in the second position.
It provides a reversible chair that can be oriented in two different orientations and that is as simple and cheap as possible.

13 Claims, 2 Drawing Sheets

FIG. 4
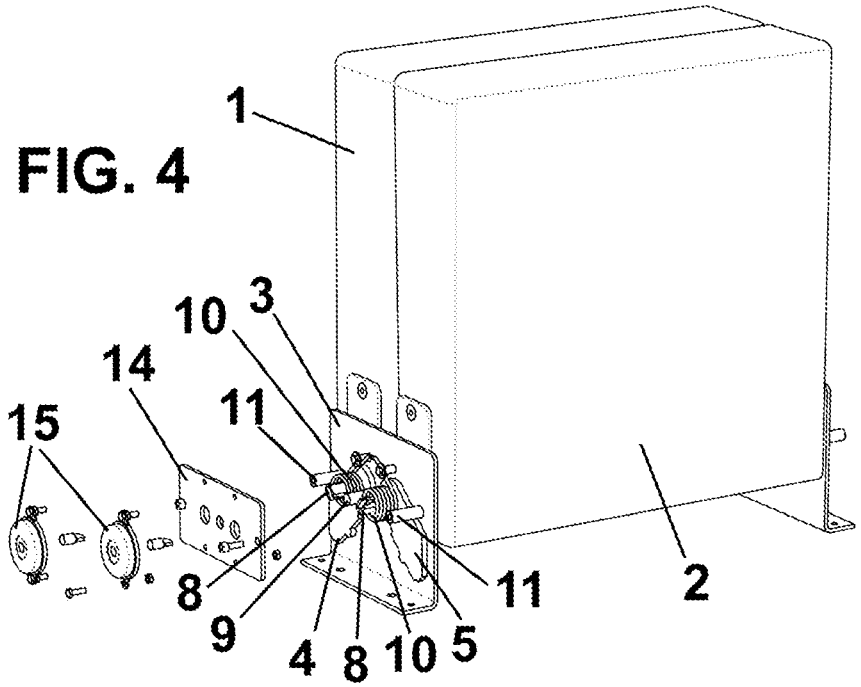
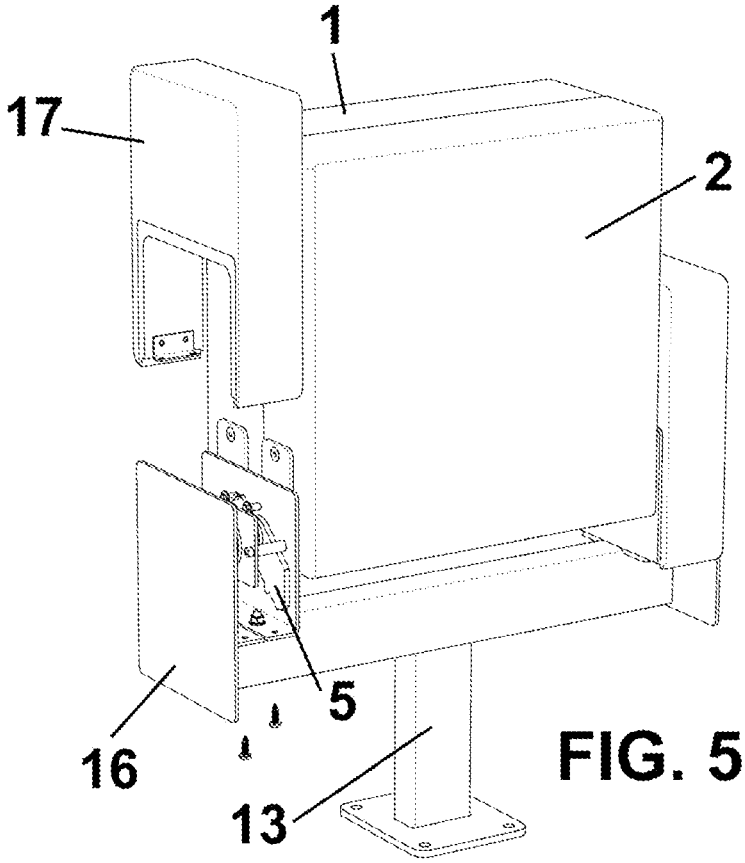
FIG. 5

REVERSIBLE CHAIR

CROSS-REFERENCE TO RELATED APPLICATION

This application is a national stage application, filed under 35 U.S.C. § 371, of International Patent Application No. PCT/ES2018/070424, filed on Jun. 13, 2018, which is incorporated by reference herein in its entirety.

The present invention relates to a reversible chair, which can be used to sit indistinctly on either side of the chair.

BACKGROUND OF THE INVENTION

Chairs are usually used in spaces such as conference rooms and the like, where it can be necessary to change the configuration of the arrangement of the chairs.

One of these changes in configuration consists of the change in the orientation of the chair, such that the users can sit towards either side of the room where the chairs are installed.

For this reason, there are chairs that are reversible and that usually comprise a fixed seat portion and a mobile backrest portion, the backrest portion being able to be placed in either of the two orientations, based on the desired use.

These reversible chairs accomplish their goal of changing the orientation, but they have the disadvantage of occupying excessive space, since the seat portion is fixed in the horizontal position thereof.

Reversible chairs are also known that are made up of two articulated portions, which can be used indistinctly as a seat portion or backrest portion, based on the position thereof.

However, these known reversible chairs have the disadvantage that the mechanism that enables the orientation to be changed and the articulated portions to be locked into position is complex and expensive, which affects the final cost of the reversible chair.

Therefore, an objective of the present invention is to provide a reversible chair that carries out the function of being able to be oriented in two different orientations and that is as simple and cheap as possible.

DESCRIPTION OF THE INVENTION

The reversible chair of the invention solves the drawbacks mentioned and has other advantages which are described below.

The reversible chair according to the present invention comprises two articulated portions with respect to a support, both articulated portions being able to be placed in a first position, wherein the articulated portion is in a substantially vertical position, and in a second position, wherein the articulated portion is in a substantially horizontal position, and it is characterised in that the chair further comprises two stop plates, each of which is joined in rotation to one of the two articulated portions, said stop plates being separated from each other when the two articulated portions are in the first position and are in contact with each other when one of the articulated portions is in the second position.

Thanks to this characteristic, the mechanism that enables the chair to be reversible is very simple to manufacture and to use, with the resulting economic savings that this entails.

Advantageously, said two stop plates are identical to each other and are placed symmetrically with respect to the support of the chair.

Furthermore, each stop plate advantageously comprises a groove and a projection that are complementary to each other.

According to a preferred embodiment, each stop plate is able to rotate around a rotation shaft located in the upper portion thereof, in the position of use, and said support comprises a shaft, which in the second position of one of the articulated portions is housed inside the groove of the stop plate joined in rotation with said articulated portion.

Preferably, said shaft is placed between said rotation shafts.

Furthermore, each stop plate comprises a spring placed around the rotation shaft thereof, which pushes each articulated portion towards the first substantially vertical portion thereof.

Preferably, said support further comprises two stop rods, which abut against each articulated portion when said articulated portions are in the first substantially vertical position thereof.

Advantageously, in each stop plate, the projection and the groove are located on one side of the stop plate, such that, in the use position thereof, the sides having the projection and the groove of the stop plates are facing each other.

According to a preferred embodiment, each of said articulated portions can be placed in a third position, wherein the articulated portion is tilted, being used as a backrest.

Furthermore, each stop plate can comprise a notch in one of the ends thereof, said notch being complementary to said projection. For example, said notch is located on the distal end of the stop plate with respect to said rotation shaft.

BRIEF DESCRIPTION OF THE DRAWINGS

For the purpose of helping to make the foregoing description more readily understandable, it is accompanied by a set of drawings which, schematically and by way of illustration and not limitation, represent an embodiment.

FIG. 4 is a perspective view of the reversible chair according to the present invention, where the position of the stop plates can be seen; and FIG. 5 is a perspective view of the reversible chair according to the present invention, in the assembly position thereof, with an armrest removed.

DESCRIPTION OF A PREFERRED EMBODIMENT

Figure 1:
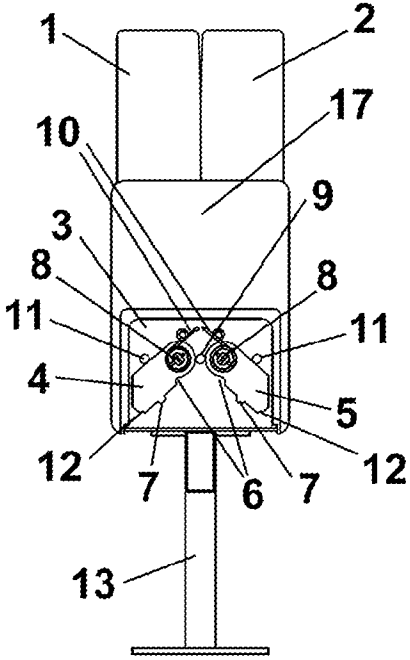
FIG. 1 is a side elevation view of the reversible chair according to the present invention, wherein the two articulated portions are in the substantially vertical position thereof.
Figure 2:
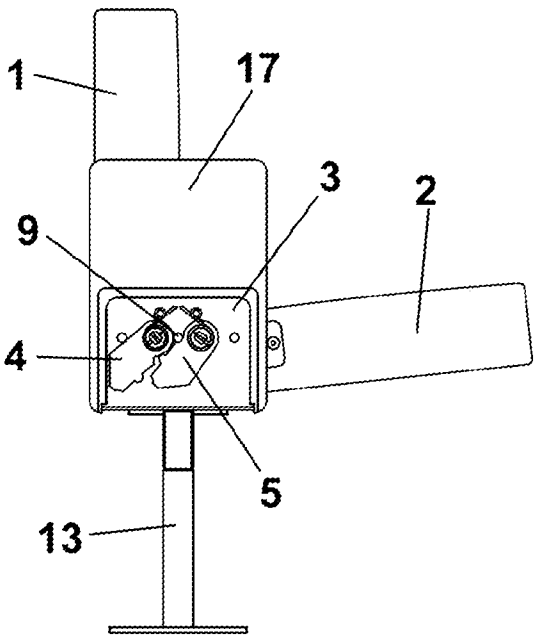
FIG. 2 is a side elevation view of the reversible chair according to the present invention, wherein one of the articulated portions is in the substantially vertical position thereof and the other is in the substantially horizontal position thereof.
Figure 3:
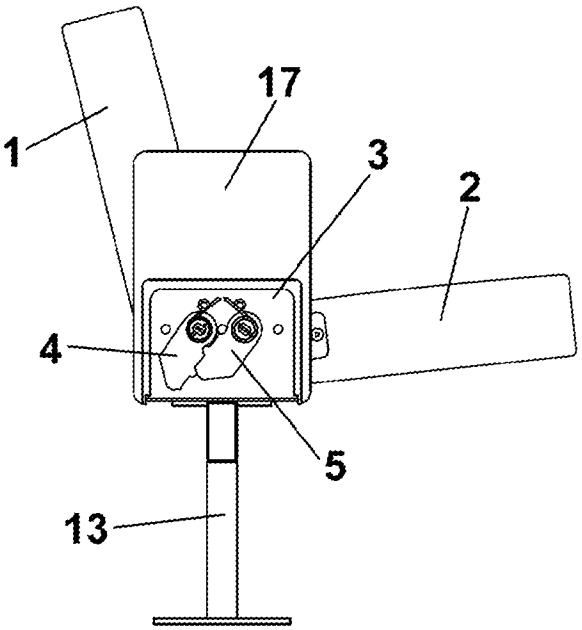
FIG. 3 is a side elevation view of the reversible chair according to the present invention, wherein one of the articulated portions is in the tilted position thereof, as a backrest, and the other in the substantially vertical position thereof, as a seat.

As seen in FIGS. 1 to 3, the reversible chair according to the present invention comprises two portions 1, 2 which are articulated with respect to a support 3 of the chair.

Said articulated portions, 1, 2 are identical to each other and can be placed in the same positions, as described below.

The positions in which the articulated portions 1, 2 can be placed are as follows:

first position: substantially vertical position, shown in FIG. 1 for the two articulated portions 1, 2 and in FIG. 2 for the articulated portion 1 located on the left;

second position: substantially horizontal position, shown in FIGS. 2 and 3 for the articulated portion 2 located on the right; and third position: tilted position, shown in FIG. 3 for the articulated portion 1 located on the left.

The position shown in FIG. 1 corresponds to the resting state of the reversible chair according to the present invention, the position shown in FIG. 2 corresponds to the manual placement by a user of one of the articulated portions in said second position, and the position shown in FIG. 3 corresponds to the position of use of the reversible chair.

FIGS. 2 and 3 show that the articulated position 2 placed on the right in these figures moves. It is clear that, if a user wants to sit towards the left, they will move the articulated portion 1 placed on the left, exactly in the same manner.

The reversible chair according to the present invention further comprises two stop plates 4, 5, each one joined in rotation to one of said articulated portions 1, 2.

The two stop plates 4, 5 are identical to each other, although it is placed in the position of use thereof symmetrically to the vertical shaft of the support 3.

Each stop plate 4, 5 comprises a rotation shaft 8, which in the embodiment shown is in the upper portion in the position of use thereof, and a groove 6 and a projection 7, which are complementary to each other.

Furthermore, a shaft 9 is arranged between said rotation shafts 8, the function of which will be explained later on, and each stop plate 4, 5 comprises a spring 10 arranged around the rotation shaft 8 thereof, such that said spring 10 will push the corresponding articulated portion 1, 2 towards the first position described above.

In the position shown in FIG. 1, the two stop plates 4, 5 are separated from each other, for example, they are substantially perpendicular to each other. In this position, the stop plates 4, 5 do not carry out any stop function, such that the user can move one of the articulated positions 1, 2 against the action of the corresponding spring 10.

In this position, the stop plates 4, 5 are in contact with stop rods 11 of said support 3, keeping them in the position shown in FIG. 1.

When the user wants to sit in the chair, they move one of the articulated portions 2 (the one on the right in the embodiment shown) to the second position thereof against the action of the spring 10. Upon moving the articulated portion 2, the stop plate 5 will rotate clockwise (according to the embodiment shown), such that the stop plates 4, 5 will touch each other and the shaft 9 will be placed inside the stop plate 5 placed on the right, as shown in FIG. 2.

In this position, the user can sit on the articulated portion 2 that is in the second position, it thus being used as a seat portion.

When the user rests on the other articulated portion 1, which is used as a backrest portion, the articulated portion 1 will be placed in the third position thereof, such that the corresponding stop plate 4 will rotate counter-clockwise, such that the projection 7 of the stop plate 5 on the right will be placed inside the groove 6 of the stop plate 4 on the left, since they are facing each other, as seen in FIG. 3.

Furthermore, if desired, the stop plates 4, 5 can comprise a notch 12 located on the distal end with respect to the rotation shaft 8, where the projection of the opposite stop plate 4, 5 is placed.

In this position, the articulated portions 1, 2 are perfectly locked to each other, since it will prevent the articulated portions 1, 2 from separating from each other, since the stop plates 4, 5 will prevent said separation movement.

When the user gets up, the articulated portions 1, 2 will be automatically moved to the first position thereof by the effects of the springs 10.

FIGS. 4 and 5 show in greater detail the components that make up the reversible chair according to the present invention, which further comprises a support foot 13.

As shown in FIGS. 4 and 5, the support 3 comprises an intermediate plate 14 and wheels 15, as well as a cover plate 16, which also covers said mechanism with an armrest 17.

It should be noted that it is not necessary for the stop plates 4, 5 to be placed on both sides of the chair, since it is only necessary for them to be placed on one side thereof in order for them to carry out the function thereof.

Despite the fact that reference has been made to a specific embodiment of the invention, it is evident for the person skilled in the art that numerous variations and changes may be made to the reversible chair described, and that all the aforementioned details may be substituted by other technically equivalent ones, without detracting from the scope of protection defined by the attached claims.

The invention claimed is:

1. A reversible chair, comprising:

two articulated portions with respect to a support, the two articulated portions configured to be placed in a first position, wherein the two articulated portions are in a substantially vertical position, and in a second position, wherein only one of the two articulated portions is in a substantially horizontal position; and two stop plates, each of which is joined and rotates with only one of the two articulated portions, said two stop plates being separated from each other when the two articulated portions are in the first position and are in contact with each other when the two articulated portions are in the second position.

2. The reversible chair according to claim 1, wherein said two stop plates are identical to each other and are placed symmetrically with respect to the support of the chair.

3. The reversible chair according to claim 2, wherein each stop plate comprises a groove and a projection that are complementary to each other.

4. The reversible chair according to claim 1, wherein each stop plate comprises a groove and a projection that are complementary to each other.

5. The reversible chair according to claim 4, wherein said support comprises a shaft, which in the second position of one of the two articulated portions is housed inside of the groove of each stop plate joined in rotation to only one of said two articulated portions.

6. The reversible chair according to claim 4, wherein each stop plate, the projection, and the groove are located on one side of the stop plate, such that, in the position of use thereof, the sides having the projection and the groove of the stop plates are facing each other.

7. The reversible chair according to claim 4, wherein each stop plate comprises a notch on one of ends thereof, said notch being complementary to said projection.

8. The reversible chair according to claim 1, wherein each stop plate is able to rotate around a rotation shaft located in an upper portion thereof, in the position of use.

9. The reversible chair according to claim 8, wherein each stop plate comprises a spring placed around the rotation shaft thereof, which pushes each articulated portion towards the first substantially vertical portion thereof.

10. The reversible chair according to claim 1, wherein each stop plate comprises a groove and a projection that are complementary to each other, each stop plate is able to rotate around a rotation shaft located in an upper portion thereof, in the position of use, said support comprises a shaft, which in the second position of one of the two articulated portions is housed inside of the groove of each stop plate joined in rotation to only one of said two articulated portions, and said shaft is placed between said rotation shafts.

11. The reversible chair according to claim 1, wherein said support comprises two stop rods, which abut against each articulated portion when said two articulated portions are in the first substantially vertical position thereof.

12. The reversible chair according to claim 1, wherein each one of said two articulated portions can be placed in a third position, wherein each articulated portion is tilted.

13. The reversible chair according to claim 1, wherein each stop plate comprises a groove and a projection that are complementary to each other, each stop plate is able to rotate around a rotation shaft located in an upper portion thereof, in the position of use, each stop plate comprises a notch on one of ends thereof, said notch being complementary to said projection, and said notch is located on a distal end of each stop plate with respect to said rotation shaft.

* * * * *